US006702927B2

(12) United States Patent
Moriarty et al.

(10) Patent No.: US 6,702,927 B2
(45) Date of Patent: Mar. 9, 2004

(54) SEAMING OF SPIRALLY WOUND PAPER MACHINE CLOTHING

(75) Inventors: Michael Glenn Moriarty, Ballston Lake, NY (US); Michael A. Royo, Delmar, NY (US)

(73) Assignee: Albany International Corp., Albany, NY (US)

( * ) Notice: Subject to any disclaimer, the term of this patent is extended or adjusted under 35 U.S.C. 154(b) by 0 days.

(21) Appl. No.: 10/112,501

(22) Filed: Mar. 27, 2002

(65) Prior Publication Data

US 2003/0183296 A1 Oct. 2, 2003

(51) Int. Cl.[7] ..... D21F 7/10; D03D 3/04

(52) U.S. Cl. ..... 162/358.2; 162/900; 162/904; 442/186; 139/383 A; 139/383 AA; 28/142

(58) Field of Search ..... 139/383 A, 383 AA, 139/425 A; 162/116, 117, 306, 348, 358.1, 358.2, 358.3, 358.4, 900–904; 442/185, 186, 239, 268, 270; 428/192, 193, 58, 60; 28/110, 142

(56) References Cited

U.S. PATENT DOCUMENTS 3,900,659 A * 8/1975 MacBean ..... 428/223
5,360,656 A * 11/1994 Rexfelt et al. ..... 428/193
5,713,399 A * 2/1998 Collette et al. ..... 139/383 AA
6,124,015 A * 9/2000 Baker et al. ..... 428/99
6,440,881 B1 8/2002 Ercken ..... 442/320

* cited by examiner

*Primary Examiner*—Steven P. Griffin
*Assistant Examiner*—Eric Hug
(74) *Attorney, Agent, or Firm*—Frommer Lawrence & Haug LLP; Ronald R. Santucci

(57) ABSTRACT

A papermaker's fabric is made by spirally winding a woven fabric strip. The fabric strip has first and second lateral edges, along which are a first and second lip, respectively. Each lip has at least one lengthwise yarn woven with crosswise yarns. Adjacent to and inward of the first and second lips on the fabric strip are a first and second gap, respectively, which lack lengthwise yarns but whose crosswise yarns join the lips to the body of the fabric strip. When spirally winding the fabric strip, the first lip is disposed within the second gap, and the second lip is disposed within the first gap, of adjacent turns to form a spirally continuous seam which is closed by attaching adjacent turns to one another.

28 Claims, 5 Drawing Sheets

SEAMING OF SPIRALLY WOUND PAPER MACHINE CLOTHING

BACKGROUND OF THE INVENTION

1. Field of the Invention

The present invention relates to the seaming of fabrics into endless loops for use as paper machine clothing or as a component in paper machine clothing, such as forming, press and dryer fabrics, or as a base for a polymer-coated paper industry process belt, such as a long nip press belt. More specifically, the invention concerns the formation of a spirally continuous seam in the production of wide paper machine clothing from a relatively narrow, spirally wound woven fabric strip.

2. Description of the Prior Art

During the papermaking process, a cellulosic fibrous web is formed by depositing a fibrous slurry, that is, an aqueous dispersion of cellulose fibers, onto a moving forming fabric in the forming section of a paper machine. A large amount of water is drained from the slurry through the forming fabric, leaving the cellulosic fibrous web on the surface of the forming fabric.

The newly formed cellulosic fibrous web proceeds from the forming section to a press section, which includes a series of press nips. The cellulosic fibrous web passes through the press nips supported by a press fabric, or, as is often the case, between two such press fabrics. In the press nips, the cellulosic fibrous web is subjected to compressive forces which squeeze water therefrom, and which adhere the cellulosic fibers in the web to one another to turn the cellulosic fibrous web into a paper sheet. The water is accepted by the press fabric or fabrics and, ideally, does not return to the paper sheet.

The paper sheet finally proceeds to a dryer section, which includes at least one series of rotatable dryer drums or cylinders, which are internally heated by steam. The newly formed paper sheet is directed in a serpentine path sequentially around each in the series of drums by a dryer fabric, which holds the paper sheet closely against the surfaces of the drums. The heated drums reduce the water content of the paper sheet to a desirable level through evaporation.

It should be appreciated that the forming, press and dryer fabrics all take the form of endless loops on the paper machine and function in the manner of conveyors. It should further be appreciated that paper manufacture is a continuous process which proceeds at considerable speeds. That is to say, the fibrous slurry is continuously deposited onto the forming fabric in the forming section, while a newly manufactured paper sheet is continuously wound onto rolls after it exits from the dryer section.

The present invention relates primarily to the press fabrics used in the press section, generally known as press fabrics, but it may also find application in the fabrics used in the forming and dryer sections, as well as in those used as bases for polymer-coated paper industry process belts, such as, for example, long nip press belts.

Press fabrics play a critical role during the paper manufacturing process. One of their functions, as implied above, is to support and to carry the paper product being manufactured through the press nips.

Press fabrics also participate in the finishing of the surface of the paper sheet. That is, press fabrics are designed to have smooth surfaces and uniformly resilient structures, so that, in the course of passing through the press nips, a smooth, mark-free surface is imparted to the paper.

Perhaps most importantly, the press fabrics accept the large quantities of water extracted from the wet paper in the press nip. In order to fill this function, there literally must be space, commonly referred to as void volume, within the press fabric for the water to go, and the fabric must have adequate permeability to water for its entire useful life. Finally, press fabrics must be able to prevent the water accepted from the wet paper from returning to and rewetting the paper upon exit from the press nip.

Contemporary press fabrics are used in a wide variety of styles designed to meet the requirements of the paper machines on which they are installed for the paper grades being manufactured. Generally, they comprise a woven base fabric into which has been needled a batt of fine, non-woven fibrous material. The base fabrics may be woven from monofilament, plied monofilament, multifilament or plied multifilament yarns, and may be single-layered, multi-layered or laminated. The yarns are typically extruded from any one of several synthetic polymeric resins, such as polyamide and polyester resins, used for this purpose by those of ordinary skill in the paper machine clothing arts.

The woven base fabrics themselves take many different forms. For example, they may be woven endless, or flat woven and subsequently rendered into endless form with a woven seam. Alternatively, they may be produced by a process commonly known as modified endless weaving, wherein the widthwise edges of the base fabric are provided with seaming loops using the machine-direction (MD) yarns thereof. In this process, the MD yarns weave continuously back-and-forth between the widthwise edges of the fabric, at each edge turning back and forming a seaming loop. A base fabric produced in this fashion is placed into endless form during installation on a paper machine, and for this reason is referred to as an on-machine-seamable fabric. To place such a fabric into endless form, the two widthwise edges are brought together, the seaming loops at the two edges are interdigitated with one another, and a seaming pin or pintle is directed through the passage formed by the interdigitated seaming loops.

Further, the woven base fabrics may be laminated by placing one base fabric within the endless loop formed by another and by needling a staple fiber batt through both base fabrics to join them to one another. One or both woven base fabrics may be of the on-machine-seamable type.

In any event, the woven base fabrics are in the form of endless loops, or are seamable into such forms, having a specific length, measured longitudinally therearound, and a specific width, measured transversely thereacross. Because paper machine configurations vary widely, paper machine clothing manufacturers are required to produce press fabrics, and other paper machine clothing, to the dimensions required to fit particular positions in the paper machines of their customers. Needless to say, this requirement makes it difficult to streamline the manufacturing process, as each press fabric must typically be made to order.

In response to this need to produce press fabrics in a variety of lengths and widths more quickly and efficiently, press fabrics have been produced in recent years using a spiral winding technique disclosed in commonly assigned U.S. Pat. No. 5,360,656 to Rexfelt et al., the teachings of which are incorporated herein by reference.

U.S. Pat. No. 5,360,656 shows a press fabric comprising a base fabric having one or more layers of staple fiber material needled thereinto. The base fabric comprises at least one layer composed of a spirally wound strip of woven fabric having a width which is smaller than the width of the base fabric. The base fabric is endless in the longitudinal, or machine, direction. Lengthwise threads of the spirally wound strip make an angle with the longitudinal direction of the press fabric. The strip of woven fabric may be flat-woven on a loom which is narrower than those typically used in the production of paper machine clothing.

The base fabric comprises a plurality of spirally wound and joined turns of the relatively narrow woven fabric strip. The fabric strip is woven from lengthwise (warp) and crosswise (filling) yarns. Adjacent turns of the spirally wound fabric strip may be abutted against one another, and the spirally continuous seam so produced may be closed by sewing, stitching, melting, or welding (e.g. ultrasonic) or gluing. Alternatively, adjacent longitudinal edge portions of adjoining spiral turns may be arranged overlappingly, so long as the edges have a reduced thickness, so as not to give rise to an increased thickness in the area of the overlap. Alternatively still, the spacing between lengthwise yarns may be increased at the edges of the strip, so that, when adjoining spiral turns are arranged overlappingly, there may be an unchanged spacing between lengthwise threads in the area of the overlap.

In any case, a woven base fabric, taking the form of an endless loop and having an inner surface, a longitudinal (machine) direction and a transverse (cross-machine) direction, is the result. The lateral edges of the woven base fabric are then trimmed to render them parallel to its longitudinal (machine) direction. The angle between the machine direction of the woven base fabric and the spirally continuous seam may be relatively small, that is, typically less than 10°. By the same token, the lengthwise (warp) yarns of the woven fabric strip make the same relatively small angle with the longitudinal (machine) direction of the woven base fabric. Similarly, the crosswise (filling) yarns of the woven fabric strip, being perpendicular to the lengthwise (warp) yarns, make the same relatively small angle with the transverse (cross-machine) direction of the woven base fabric. In short, neither the lengthwise (warp) nor the crosswise (filling) yarns of the woven fabric strip align with the longitudinal (machine) or transverse (crossmachine) directions of the woven base fabric.

Commonly assigned U.S. Pat. No. 5,713,399 to Collette et al., the teachings of which are incorporated herein by reference, shows a further approach to forming and closing the spirally continuous seam in a fabric of this type. According to the disclosed method, the fabric strip has a lateral fringe along at least one lateral edge thereof, the lateral fringe being unbound ends of its crosswise yarns extending beyond the lateral edge. During the spiral winding of the fringed strip, the lateral fringe of a turn overlies or underlies an adjacent turn of the strip, the lateral edges of the adjacent turns abutting against one another. The spirally continuous seam so obtained is closed by ultrasonically welding or bonding the overlying or underlying lateral fringe to the fabric strip in an adjacent turn.

The present invention provides yet another approach toward forming the spirally continuous seam in a fabric of this type.

SUMMARY OF THE INVENTION

Accordingly, the present invention is both a method for manufacturing a papermaker's fabric, and the fabric made in accordance with the method.

The papermaker's fabric comprises a fabric strip woven from lengthwise yarns and crosswise yarns and having first lateral edge and a second lateral edge.

Along the first and second lateral edges are a first lip and a second lip, respectively.

The first and second lips each have at least one lengthwise yarn woven with the crosswise yarns.

Adjacent to and inward of the first and second lips on the fabric strip are a first gap and a second gap. The first and second gaps both lack lengthwise yarns, which have either been removed therefrom following the weaving of the fabric strip or have been omitted during the weaving process. The first and second gaps, however, have unbound lengths of crosswise yarns which connect the first and second lips to the body of the fabric strip.

The first lip is no wider than the second gap, and the second lip is no wider than the first gap. As the fabric strip is spirally wound in a plurality of contiguous turns to produce the papermaker's fabric, the first lip is disposed in the second gap in an adjacent turn thereof, and the second lip is disposed in the first gap in the adjacent turn. In this manner, a spirally continuous seam separating adjacent turns of the fabric strip from one another is formed. The spirally continuous seam is closed by attaching each turn of the fabric strip to those adjacent thereto, thereby providing an endless papermaker's fabric having a machine direction, a crossmachine direction, an inner surface and an outer surface.

The present invention will now be described in more complete detail with frequent reference being made to the figures identified as follows.

DETAILED DESCRIPTION OF THE PREFERRED EMBODIMENT

Figure 1:
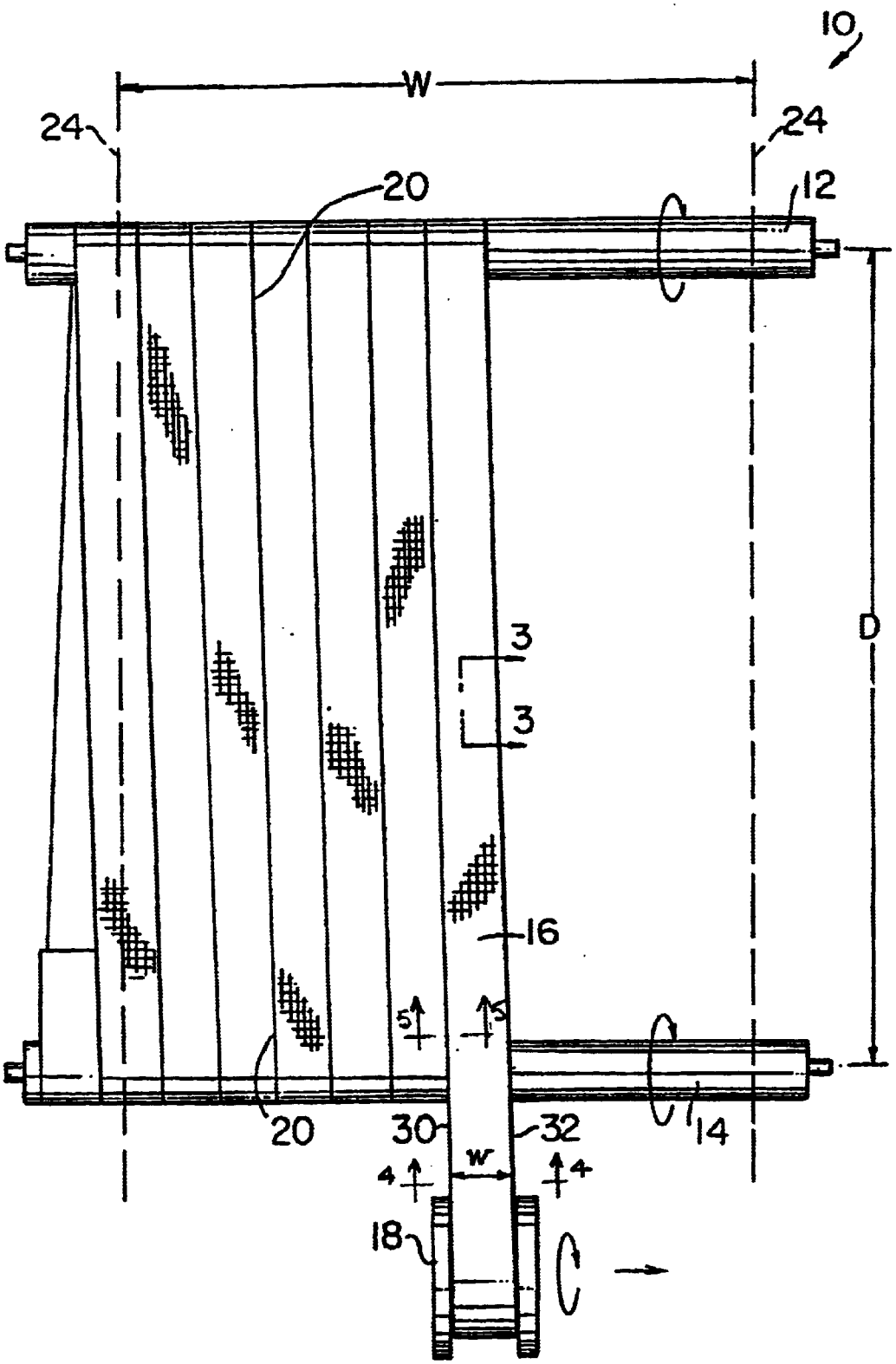
FIG. 1 is a schematic top plan view illustrating a method for manufacturing a papermaker's fabric.

Referring now to the several figures, FIG. 1 is a schematic top plan view illustrating a method for manufacturing a papermaker's fabric. The method may be practiced using an apparatus 10 comprising a first roll 12 and a second roll 14, which are parallel to one another and which may be rotated in the directions indicated by the arrows. A woven fabric strip 16 is wound from a stock roll 18 around the first roll 12 and the second roll 14 in a continuous spiral. It will be recognized that it may be necessary to translate the stock roll 18 at a suitable rate along second roll 14 (to the right in FIG. 1) as the fabric strip 16 is being wound around the rolls 12, 14.

Figure 2:
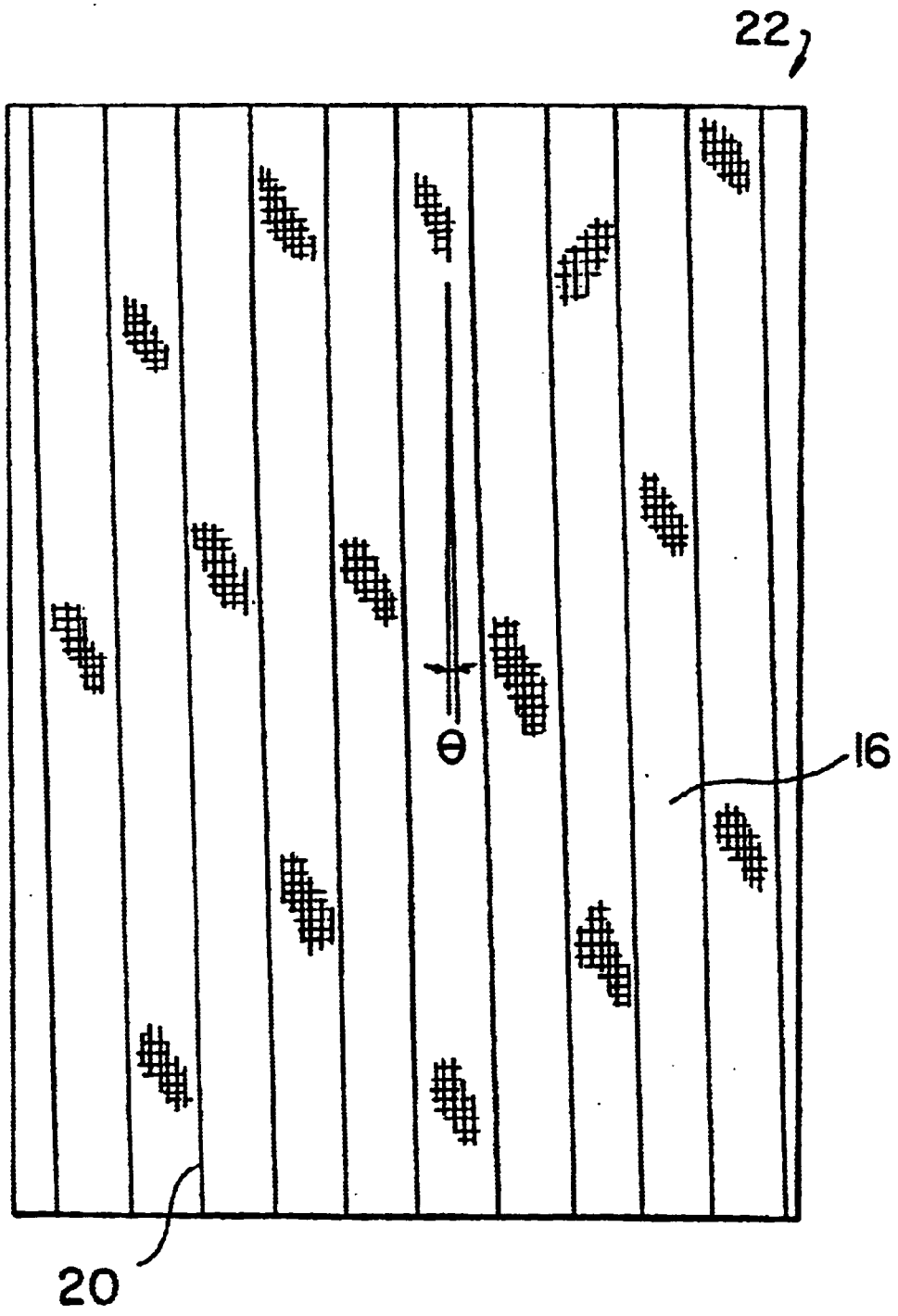
FIG. 2 is a top plan view of the finished papermaker's fabric.

The first roll 12 and the second roll 14 are separated by a distance D, which is determined with reference to the total length required for the papermaker's fabric being manufactured, the total length being measured longitudinally (in the machine direction) about the endless-loop form of the papermaker's fabric. Woven fabric strip 16, having a width w, is spirally wound onto the first and second rolls 12, 14 in a plurality of turns from stock roll 18, which may be translated along the second roll 14 in the course of the winding. Successive turns of the fabric strip 16 are disposed relative to one another in the manner to be illustrated below, and are attached to one another along spirally continuous seam 20 by sewing, stitching, melting, welding (e.g. ultrasonic) or gluing, to produce papermaker's fabric 22 as shown in FIG. 2. When a sufficient number of turns of the fabric strip 16 have been made to produce a papermaker's fabric 22 of desired width W, that width being measured transversely (in the cross-machine direction) across the endless-loop form of the papermaker's fabric 22, the spiral winding is concluded. The papermaker's fabric 22 so obtained has an inner surface, an outer surface, a machine direction and a cross-machine direction. Initially, the lateral edges of the papermaker's fabric 22, it will be apparent, will not be parallel to the machine direction thereof, and must be trimmed along lines 24 to provide the papermaker's fabric 22 with the desired width W, and with two lateral edges parallel to the machine direction of its endless-loop form.

Fabric strip 16 may be woven from monofilament, plied monofilament or multifilament yarns of a synthetic polymeric resin, such as polyester or polyamide, in the same manner as other fabrics used in the papermaking industry are woven. After weaving, it may be heatset in a conventional manner prior to interim storage on stock roll 18. Fabric strip 16 includes lengthwise yarns and crosswise yarns, wherein, for example, the lengthwise yarns may be plied monofilament yarns while the crosswise yarns may be monofilament yarns. Further, fabric strip 16 may be of a single- or multi-layer weave.

Alternatively, fabric strip 16 may be woven and heatset in a conventional manner, and fed directly to apparatus 10 from a heatsetting unit without interim storage on a stock roll 18. It may also be possible to eliminate heatsetting with the proper material selection and product construction (weave, yarn sizes and counts). In such a situation, fabric strip 16 would be fed to the apparatus 10 from a weaving loom without interim storage on a stock roll 18.

Figure 3:
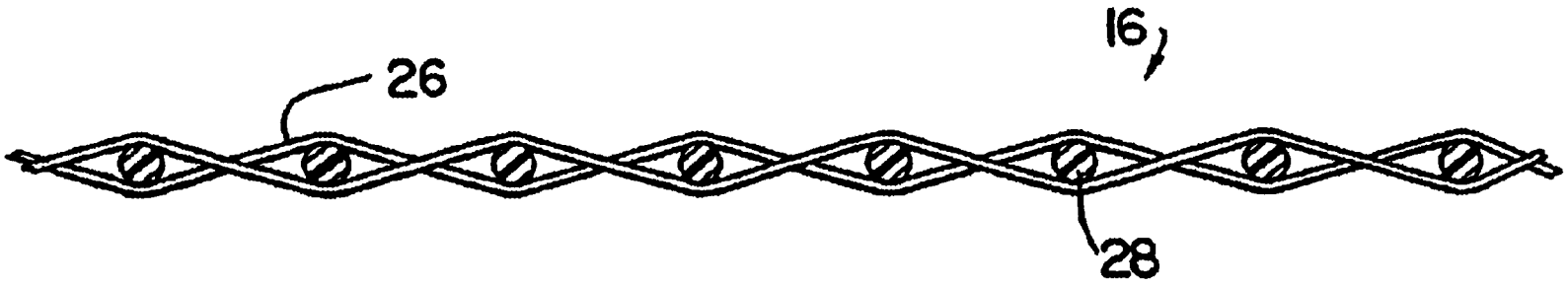
FIG. 3 is a cross-sectional view taken as indicated by line 3—3 in FIG. 1.

FIG. 3 is a cross section of fabric strip 16 taken as indicated by line 3—3 in FIG. 1. It comprises lengthwise yarns 26 and crosswise yarns 28, both of which are represented as monofilaments, interwoven in a singlelayer weave. More specifically, a plain weave is shown, although, it should be understood, the fabric strip 16 may be woven according to any of the weave patterns commonly used to weave paper machine clothing. Because the fabric strip 16 is spirally wound to assemble papermaker's fabric 22, lengthwise yarns 26 and crosswise yarns 28 do not align with the machine and cross-machine directions, respectively, of the papermaker's fabric 22. Rather, the lengthwise yarns 26 make a slight angle, θ, whose magnitude is a measure of the pitch of the spiral windings of the fabric strip 16, with respect to the machine direction of the papermaker's fabric 22, as suggested by the top plan view thereof shown in FIG. 2. This angle, as previously noted, is typically less than 10°. Because the crosswise yarns 28 of the fabric strip 16 generally cross the lengthwise yarns 26 at a 90° angle, the crosswise yarns 28 make the same slight angle, A, with respect to the cross-machine direction of the fabric 22.

Figure 4:
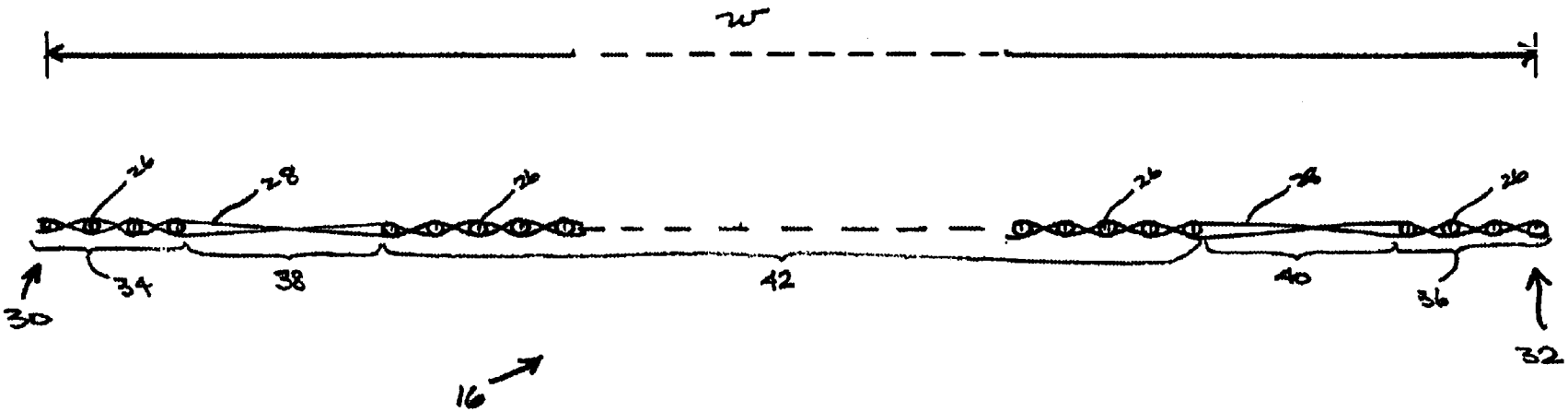
FIG. 4 is an enlarged cross-sectional view taken as indicated by line 4—4 in FIG. 1.

Referring back to FIG. 1, woven fabric strip 16 has a first lateral edge 30 and a second lateral edge 32. FIG. 4 is an enlarged cross-sectional view of the woven fabric strip 16 taken as indicated in FIG. 1. As shown in FIG. 4, a first lip 34 is disposed along first lateral edge 30, and a second lip 36 runs along second lateral edge 32. Each lip 34, 36 comprises at least one, but preferably a plurality of, lengthwise yarns 26 interwoven with crosswise yarns 28. As shown in FIG. 4, each lip 34, 36 comprises four lengthwise yarns 26, but, it should be understood, that present invention is not so limited.

Adjacent to, and inward of the first and second lips 34, 36 on the woven fabric strip 16 are a first gap 38 and a second gap 40, respectively. Each gap 38, 40 comprises unbound lengths of crosswise yarns 28, which connect the first and second lips 34, 36 to the body 42 of the woven fabric strip 16. Each gap 38, 40 lacks at least one, but preferably a plurality of, lengthwise yarns 26, which have either been omitted during the weaving of woven fabric strip 16, or have been removed thereafter. As implied in FIG. 4, each gap 38, 40 lacks four lengthwise yarns 26, but, it should be understood, the present invention is not so limited.

Figure 5:
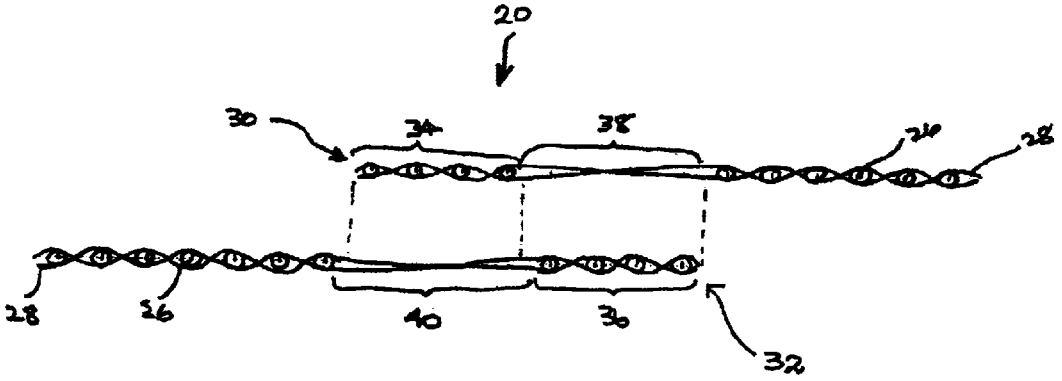
FIG. 5 is an enlarged, exploded cross-sectional view taken as indicated by line 5—5 in FIG. 1.

FIG. 5 is an enlarged, exploded crosssectional view taken as indicated by line 5—5 in FIG. 1, and is provided to illustrate the manner in which fabric strip 16 is wound onto first and second parallel rolls 12, 14 to form spirally continuous seam 20. once the first of the plurality of spirally wound turns of woven fabric strip 16 is completed, successive turns are disposed such that the first lip 34 of each succeeding turn of the woven fabric strip 16 overlies the second gap 40 of the immediately preceding turn, and such that the first gap 38 of each succeeding turn overlies the second lip 36 of the immediately preceding turn.

It will be readily apparent to those of ordinary skill in the art that the width of the first lip 34 should be no greater than the width of the second gap 40, and that the width of the second lip 36 should be no greater than the width of the first gap 38, so that, when the first lateral edge 30 overlies the second lateral edge 32 of the immediately preceding turn, a spirally continuous seam having substantially the same thickness as the body 42 of the woven fabric strip 16 may result. Optimally, the number of lengthwise yarns 26 in first lip 34 is equal to the number of lengthwise yarns 26 missing from the second gap 40, and the number of lengthwise yarns 26 in the second lip 36 is equal to the number of lengthwise yarns 26 missing from the first gap 38, so that, when the spirally continuous seam 20 is closed by sewing, stitching, melting, welding (e.g. ultrasonic) or gluing or some other available method, the density of lengthwise yarns 26 across the area of the spirally continuous seam 20 is the same as that in the body 42 of the woven fabric strip 16.

Modifications to the above would be obvious to those of ordinary skill in the art, but would not bring the invention so modified beyond the scope of the appended claims.

For example, in the method illustrated above, the first lateral edge 30 of subsequent turns of the woven fabric strip 16 overlies the second lateral edge 32 of those previously wound. However, those of ordinary skill in the art might take a different approach without departing form the scope of the invention as defined by the appended claims. For example, a subsequently wound turn of fabric strip 16 may be brought up under the second lateral edge 32 of the previously wound turn with the result that first lateral edge 30 underlies the second lateral edge 32 of the previous turn. Also if preferred, same selected CD yarn segments in the gap may be removed so that the entire "lip/gap" is more like that in the main fabric strip body.

What is claimed is:

1. A papermaker's fabric comprising a fabric strip woven from lengthwise yarns and crosswise yarns, said fabric strip having a first lateral edge, a second lateral edge, a first lip along said first lateral edge, a second lip along said second lateral edge, a first gap adjacent to and inward of said first lip, a second gap adjacent to and inward of said second lip, and a body between said first gap and said second gap, said first lip and said second lip each having at least one lengthwise yarn woven with said crosswise yarns, said first gap and said second gap each lacking lengthwise yarns, having fewer crosswise yarns per unit area than said body, and having unbound lengths of said crosswise yarns connecting said first lip and said second lip, respectively, to said body, said first lip being no wider than said second gap and said second lip being no wider than said first gap, said fabric strip being spirally wound in a plurality of contiguous turns, wherein said first lip is disposed in said second gap in an adjacent turn thereof, and wherein said second lip is disposed in said first gap in said adjacent turn, thereby forming a spirally continuous seam separating adjacent turns of said fabric strip from one another, said spirally continuous seam being closed by attaching each turn of said fabric strip to those adjacent thereto without use of a hinge or pintle pin, thereby providing an endless papermaker's fabric having a machine direction, a cross-machine direction, an inner surface and an outer surface.

2. A papermaker's fabric as claimed in claim 1 wherein said woven fabric strip is of a single-layer weave.

3. A papermaker's fabric as claimed in claim 1 wherein said woven fabric strip is of a multi-layer weave.

4. A papermaker's fabric as claimed in claim 1 wherein said lengthwise yarns and said crosswise yarns are of a synthetic polymeric resin.

5. A papermaker's fabric as claimed in claim 1 wherein said lateral edges are trimmed in a direction parallel to said machine direction thereof.

6. A papermaker's fabric as claimed in claim 1 wherein said lengthwise yarns of said fabric strip make an angle of less than 10° with respect to the machine direction of said papermaker's fabric.

7. A papermaker's fabric as claimed in claim 1 wherein adjacent turns of said spirally wound fabric strip are attached to one another by a process selected from the group consisting of sewing, stitching, melting, welding and gluing.

8. A papermaker's fabric as claimed in claim 1 wherein said first lip has a plurality of lengthwise yarns woven with said crosswise yarns.

9. A papermaker's fabric as claimed in claim 1 wherein said second lip has a plurality of lengthwise yarns woven with said crosswise yarns.

10. A papermaker's fabric as claimed in claim 1 wherein at least one of said first lip and said second lip has a plurality of lengthwise yarns woven with said crosswise yarns.

11. A method for manufacturing a papermaker's fabric comprising the steps of:

a) manufacturing a fabric strip woven from lengthwise yarns and crosswise yarns, said fabric strip having a first lateral edge, a second lateral edge, a first lip along said first lateral edge, a second lip along said second lateral edge, a first gap adjacent to and inward of said first lip, a second gap adjacent to and inward of said second lip, and a body between said first gap and said second gap, said first lip and said second lip each having at least one lengthwise yarn woven with said crosswise yarns, said first gap and said second gap each lacking lengthwise yarns, having fewer crosswise yarns per unit area than said body, and having unbound lengths of said crosswise yarns connecting said first lip and said second lip, respectively, to said body, said first lip being no wider than said second gap and said second lip being no wider than said first gap;

b) spirally winding said fabric strip in a plurality of turns, wherein said first lip is disposed in said second gap in an adjacent turn thereof, and wherein said second lip is disposed in said first gap in an adjacent turn thereof, thereby forming a spirally continuous seam separating adjacent turns of said fabric strip from one another; and c) attaching each turn of said fabric strip to that adjacent thereto without use of a hinge or pintle pin, thereby providing an endless papermaker's fabric having a machine direction, a cross-machine direction, an inner surface and an outer surface.

12. A method as claimed in claim 11 wherein said step of manufacturing said fabric strip comprises removing at least one lengthwise yarn therefrom to produce said first gap.

13. A method as claimed in claim 11 wherein said step of manufacturing said fabric strip comprises removing a plurality of lengthwise yarns therefrom to produce said first gap.

14. A method as claimed in claim 11 wherein said step of manufacturing said fabric strip comprises removing at least one lengthwise yarn therefrom to produce said second gap.

15. A method as claimed in claim 11 wherein said step of manufacturing said fabric strip comprises removing a plurality of lengthwise yarns therefrom to produce said second gap.

16. A method as claimed in claim 11 wherein said step of manufacturing said fabric strip comprises removing a plurality of lengthwise yarns therefrom to produce at least one of said first gap and said second gap.

17. A method as claimed in claim 11 wherein said step of manufacturing said fabric strip comprises omitting at least one lengthwise yarn therefrom to produce said first gap.

18. A method as claimed in claim 11 wherein said step of manufacturing said fabric strip comprises omitting a plurality of lengthwise yarns therefrom to produce said first gap.

19. A method as claimed in claim 11 wherein said step of manufacturing said fabric strip comprises omitting at least one lengthwise yarn therefrom to produce said second gap.

20. A method as claimed in claim 11 wherein said step of manufacturing said fabric strip comprises omitting a plurality of lengthwise yarns therefrom to produce said second gap.

21. A method as claimed in claim 11 wherein said step of manufacturing said fabric strip comprises omitting a plurality of lengthwise yarns therefrom to produce at least one of said first gap and said second gap.

22. The method as claimed in claim 11 wherein said woven fabric strip is of a single-layer weave.

23. The method as claimed in claim 11 wherein said woven fabric strip is of a multi-layer weave.

24. The method as claimed in claim 11 wherein said lengthwise yarns and said crosswise yarns are of a synthetic polymeric resin.

25. The method as claimed in claim 11 wherein the step of spirally winding said fabric strip is performed by spirally winding said fabric strip about at least two parallel rolls.

26. The method as claimed in claim 11 further comprising the step of heatsetting said woven fabric strip following the step of manufacturing said fabric strip.

27. The method as claimed in claim 11 further comprising the step of trimming said papermaker's fabric to provide said papermaker's fabric with lateral edges parallel to each other and to the machine direction thereof.

28. The method as claimed in claim 11 wherein the step of attaching each turn of said fabric strip to that adjacent thereto is performed by a process selected from the group consisting of sewing, stitching, melting, welding and gluing.

* * * * *